US006981810B2

(12) United States Patent
Akashi et al.

(10) Patent No.: US 6,981,810 B2
(45) Date of Patent: Jan. 3, 2006

(54) PRINTER APPARATUS HAVING PLATEN ROLLER WITH SHEET FEED GUIDE

(75) Inventors: Yoshiharu Akashi, Daito (JP); Takahiro Okuie, Nara (JP); Hirofumi Matsushima, Fujiidera (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 10/894,363

(22) Filed: Jul. 20, 2004

(65) Prior Publication Data

US 2005/0053409 A1 Mar. 10, 2005

(30) Foreign Application Priority Data

Jul. 22, 2003 (JP) ..... 2003-199666

(51) Int. Cl.
*B41J 13/10* (2006.01)
*B41J 13/18* (2006.01)

(52) U.S. Cl. ..... 400/642; 400/643; 347/220

(58) Field of Classification Search ..... 400/643, 400/642, 645, 659, 578, 120.16, 120.17; 347/197, 220, 217, 262, 264
See application file for complete search history.

(56) References Cited

U.S. PATENT DOCUMENTS 5,296,874 A * 3/1994 Nagata et al. ..... 347/218
5,645,362 A * 7/1997 Aizawa et al. ..... 400/642

FOREIGN PATENT DOCUMENTS

EP 0 572 700 A1 * 12/1993
JP 2001-88396 4/2001

* cited by examiner

*Primary Examiner*—Leslie J. Evanisko
(74) *Attorney, Agent, or Firm*—Armstrong, Kratz, Quintos, Hanson & Brooks, LLP

(57) ABSTRACT

A printer apparatus includes: a platen roller around which paper sheets wind; a printing structure arranged for being drawn near to and away from the platen roller; a plurality of winding support members circumferentially disposed around the platen roller, for guiding a paper sheet to wrap around the roller; a sheet feed guide disposed in proximity to the printing structure and being pivotable substantially along the circumference of the roller; and a diverting mechanism for letting the sheet feed guide escape to a position such that it does not interfere with the printing structure in a print mode. The sheet feed guide is linked with a lever that pivots in a plane substantially perpendicular to the rotation axis of the platen roller, the lever having a fore-end protuberance.

4 Claims, 15 Drawing Sheets

Initial mode

Sheet feed mode

Print mode

Ink-sheet feed mode

Sheet ejecting mode

Initial mode

Sheet feed mode

Print mode

Ink-sheet feed mode (a)

(b)

(c)

Sheet ejecting mode

PRINTER APPARATUS HAVING PLATEN ROLLER WITH SHEET FEED GUIDE

BACKGROUND OF THE INVENTION

1. Field of the Invention

The present invention relates to printer apparatus in which a printing operation is performed by winding a paper sheet around a platen roller, and more particularly, to thermal sublimation-type printers.

2. Description of Related Art

FIG. 18 is a schematic side view of a portion of a conventional printer apparatus. (See Japanese Laid-Open Pat. App. Pub. No. 2001-88396.) This apparatus comprises a cartridge 34 disposed detachably/reattachably above a platen roller 2 around which a paper sheet S winds. Provided on one end of the platen roller 2 is a sandwiching member 35 for sandwiching the paper sheet S. The circumference of the platen roller 2 is slightly longer than the length of the paper sheet S.

A pair of winding shafts 36, 36 is disposed inside the cartridge 34, and an ink sheet 33 is suspended between the winding shafts 36, 36.

FIG. 19 is an oblique view illustrating the winding shafts 36, 36. On the ink sheet 33, three colors of ink, yellow (Y), magenta (M), and cyan (C) are coated separately along the winding direction. Above the ink sheet 33, a thermal head 31 for heating the ink sheet 33 is arranged so that it can freely goes up and down. The thermal head 31 is connected to an image processing circuit 37, and respective image information corresponding to respective colors, yellow, magenta, and cyan, is sent from the image processing circuit 37 to the thermal head 31.

In printing, the platen roller 2, sandwiching a paper sheet S with the sandwiching member 35, is rotated so that the thermal head 31 opposes a position on the paper sheet S that is to be recorded first. The winding shafts 36, 36 are rotated so that the thermal head 31 is drawn near to the first position for yellow, and the thermal head 31 is heated.

The image information corresponding to yellow is sent first to the thermal head 31. The thermal head 31 heats the ink sheet 33, causing yellow ink thereon to sublimate. With rotating the winding shafts 36, 36 and the platen roller 2 in a direction such that the ink sheet 33 is fed, the yellow component of the image information is printed on the paper sheet S. Upon completing the printing operation for yellow component, the thermal head 31 is separated from the platen roller 2. The platen roller 2 rotates, and the paper sheet S returns to the original position. Next, image information corresponding to magenta is sent to the thermal head 31, and the winding shafts 36, 36 and the platen roller 2 are rotated to print the image information of the magenta component on the paper sheet S. Likewise, image information corresponding to cyan is printed on the paper sheet S in a similar manner. Upon completing the printing operation, the thermal head 31 is separated from the platen roller 2, and the platen roller 2 is rotated to eject the paper sheet S.

In the above-described configuration, however, it is necessary to provide a cam and a link mechanism (not shown) for parting the sandwiching member 35 away from the platen roller 2. This creates a problem in that the size of the apparatus tends to increase.

BRIEF SUMMARY OF THE INVENTION

It is an object of the present invention to reduce the size of printer apparatus and stabilize the operation of the sheet feed guide 4 for guiding the feeding of paper sheets S.

A printer apparatus of the present invention includes: a platen roller 2 around which paper sheets S wind; a printing means 3 arranged for being drawn near to and away from the platen roller 2; a plurality of winding support members 21, 22, 23, and 24 circumferentially disposed around the platen roller 2, for guiding a paper sheet S to wrap around the roller 2; a sheet feed guide 4 disposed in proximity to the printing means 3 and being pivotable substantially along the circumference of the roller 2; and a diverting mechanism 40 for letting the sheet feed guide 4 escape to a position such that it does not interfere the printing means 3 in a print mode.

The sheet feed guide 4 is linked with a lever 6 that pivots in a plane substantially perpendicular to the rotation axis of the platen roller 2, the lever having a fore-end protuberance 61.

The diverting mechanism 40 comprises rotative plates 7 disposed opposing each end of the platen roller 2 and each having a cam portion 73 for guiding the protuberance 61 on the lever 6, and a rotation-restricting part 8 for controlling movement of the lever 6 in cooperation with the cam portions 73 to let the sheet feed guide 4 escape during the print mode. Cam pieces 72 provided on the rotative plates 7 control an approach/retreat operation of the winding support members 21, 22, 23, and 24 with respect to the platen roller 2.

A plurality of winding support members 21, 22, 23, and 24 that guide the paper sheet S to be wound around the roller 2 are disposed circumferentially around the platen roller 2, and their approach/retreat operation with respect to the platen roller 2 is controlled by cam pieces 72 of rotative plates 7 opposing each end of the platen roller 2. Consequently, the size of printer apparatus can be reduced in comparison with conventional apparatus.

Moreover, even if the sheet feed guide 4 and the printing means 3 are arranged close to each other, the diverting mechanism 40 lets the sheet feed guide 4 escape in a position at which the sheet feed guide 4 does not interfere with the printing means 3 during the print mode. This also serves to reduce the size of the printer apparatus.

The operation of the sheet feed guide 4 is controlled by the rotative plates 7 and rotation-restricting part 8, which constitute the diverting mechanism 40, and therefore, the operation of the sheet feed guide 4 becomes stable, thereby improving reliability.

DETAILED DESCRIPTION OF THE PREFERRED EMBODIMENTS

Outline of Overall Configuration

Figure 1:
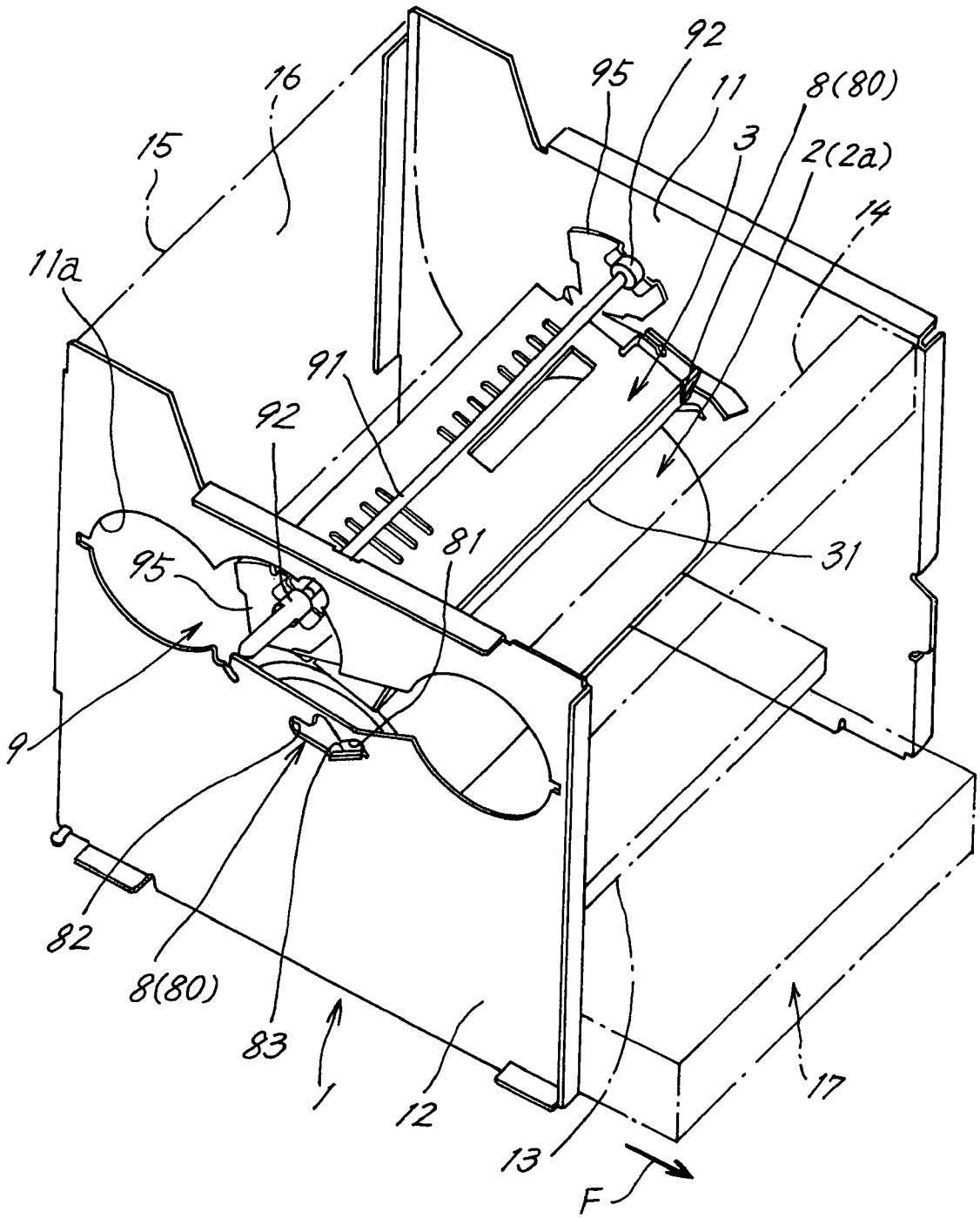
FIG. 1 is an oblique view of a thermal printer, which is a printer apparatus.
Figure 2:
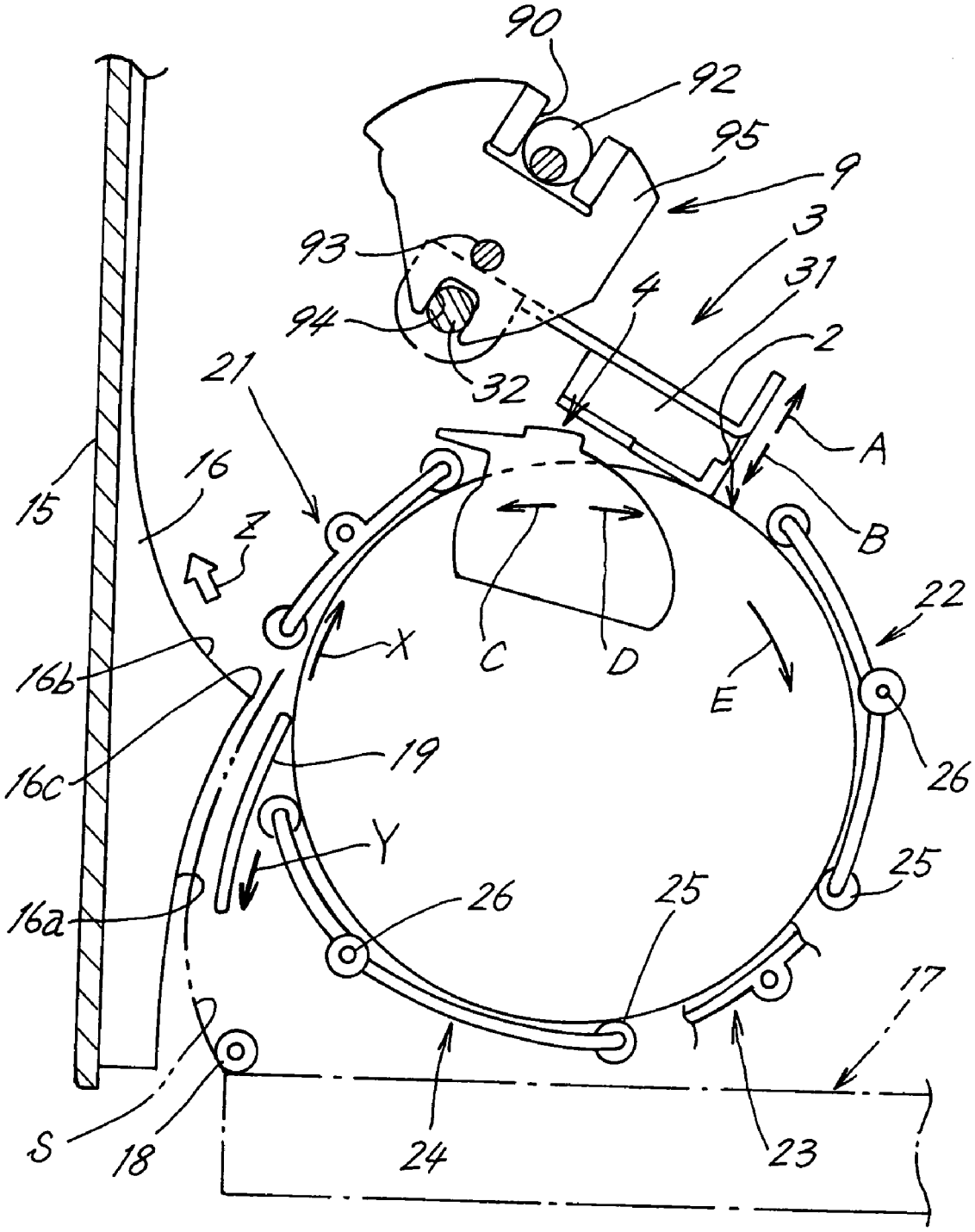
FIG. 2 is a front cross-sectional view of FIG. 1.

FIG. 1 is an oblique view of a thermal printer, which is a printer apparatus, and FIG. 2 is a front cross-sectional view of FIG. 1.

A chassis 1 of the printer is formed by left and right side plates 11 and 12 that are connected with a connecting plate 13, a stay 14, and a rear plate 15. A cartridge 34 can be inserted into or removed from the interior of the chassis 1 through an opening 11*a* formed on the side plate 12. Although a long hole 10*a* and a hole 10*b* are formed in the side plate 11 as will be described later, they are not shown in FIG. 1 for convenience in illustration.

The connecting plate 13 is positioned between the side plates 11 and 12 at their lower portions, and a sheet feed tray 17 is disposed below the connecting plate 13 so that it can be taken out in the direction away from the rear plate 15 (arrow F).

A platen roller 2, supported by the side plates 11 and 12, is disposed rotatably above the connecting plate 13. The outer layer of the platen roller 2 is formed of hard rubber.

A printing means 3 equipped with a thermal head 31 is disposed above the platen roller 2. Hereinafter, the term "front" is intended to mean the side from which the sheet feed tray 17 is taken out, and the term "rear" is intended to mean the rear plate 15 side.

As shown in FIG. 2, the printing means 3 can pivot upward and downward with the support shaft 32 being the pivotal axis, and the thermal head 31 is positioned at the frontward of the support shaft 32 so as to approach the platen roller 2 or retreat therefrom.

Figure 3:
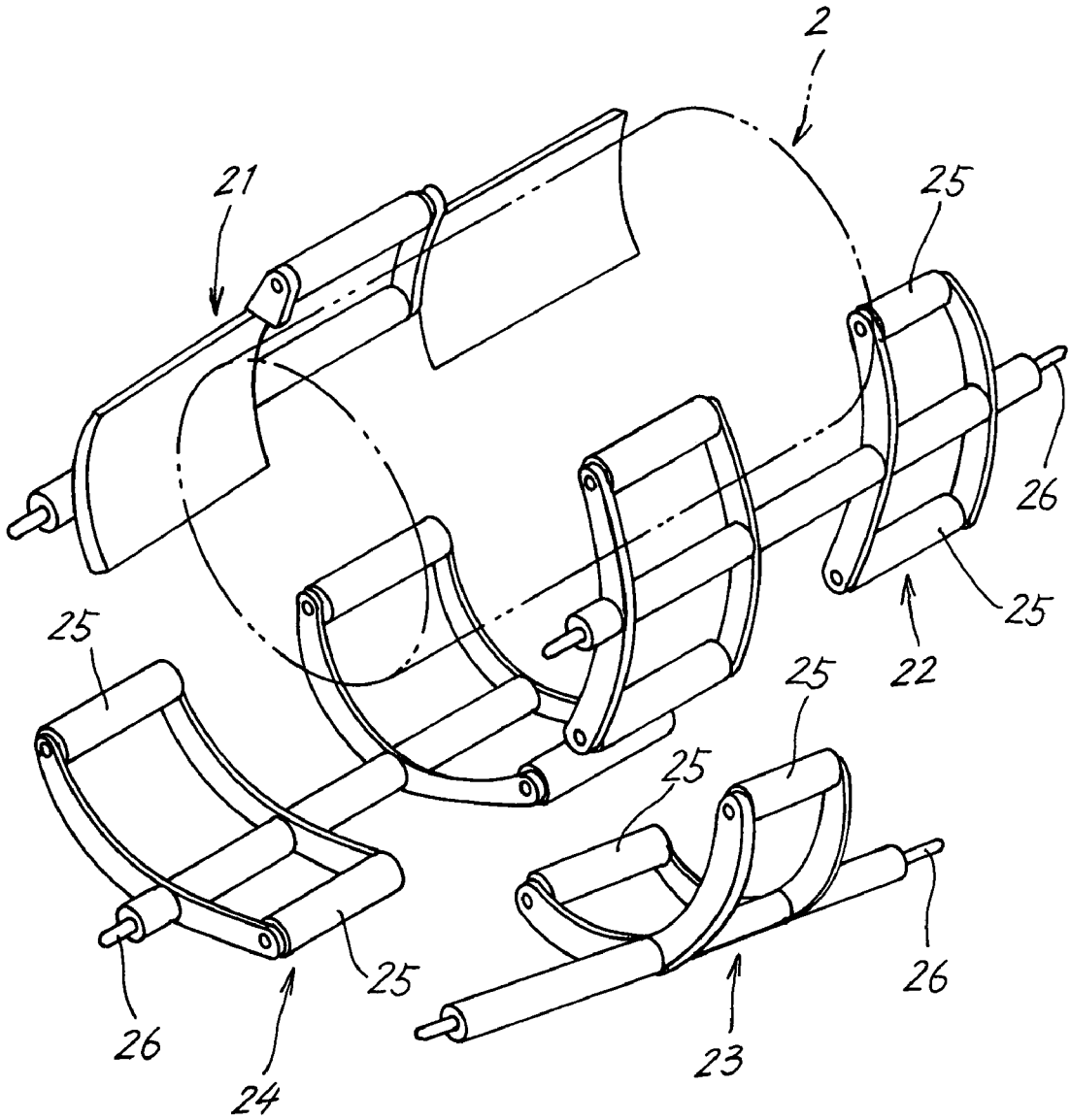
FIG. 3 is an oblique perspective view of winding support members.

Four winding support members 21, 22, 23, and 24, disposed circumferentially of the platen roller 2 and supported by the side plates 11 and 12, cover the platen roller 2. (See FIG. 3). Each of the winding support members 21, 22, 23, and 24 has small rollers 25, 25 at both ends thereof, and pivots with the support shaft 26 about a pivotal axis.

Each of the winding support members 21, 22, 23, and 24 pushes and urges the platen roller 2 by a spring (not shown). The platen roller 2 is released from the winding support members 21, 22, 23, and 24 in the vicinity of the thermal head 31, and at the released zone, a sheet feed guide 4 that can pivot back and forth (in the directions indicated by arrows C and D) is disposed over the platen roller 2.

A sheet guide wall 16 is formed on the inner surface of the rear plate 15. The guide wall 16 has a peak 16*c* that protrudes toward the center of rotation of the platen roller 2. The surface of the sheet guide wall that is downward of the peak 16*c* forms a winding guide surface 16*a* for a paper sheet S, and the surface that is upward of the peak 16*c* forms a sheet-ejecting guide surface 16*b*.

A paper sheet S, accommodated in the sheet feed tray 17, is drawn out from the rear end of the sheet feed tray 17 by a sheet feed roller 18. The paper sheet S slides on the winding guide surface 16*a*, and is guided between the first winding support member 21 and the platen roller 2, as indicated by arrow X. The paper sheet S passes under the sheet feed guide 4, the second winding support member 22, the third winding support member 23, and the fourth winding support member 24, and wraps around the platen roller 2. While the platen roller 2 rotates by one revolution, a printing operation for one color is performed, and the paper sheet S is drawn near towards the original position. When the platen roller 2 by rotates three revolutions, a printing operation for three colors finishes.

A guiding plate 19 is disposed pivotably between the first winding support member 21 and the fourth winding support member 24. During the time in which the platen roller 2 rotates by three revolutions, the guiding plate 19 forcibly guides the paper sheet S that passes under the fourth winding support member 24 toward the first winding support member 21 side.

After the platen roller 2 has rotated three revolutions, the guiding plate 19 pivots downward, as indicated by arrow Y, releasing the transfer path from the fourth winding support member 24 to the sheet-ejecting guide surface 16*b* of the guide wall 16 so that the paper sheet S travels toward the sheet-ejecting guide surface 16*b*. Upon finishing sheet ejection, the guiding plate 19 returns to the original position.

Details of Sheet Feed Guide 4

Figure 4:
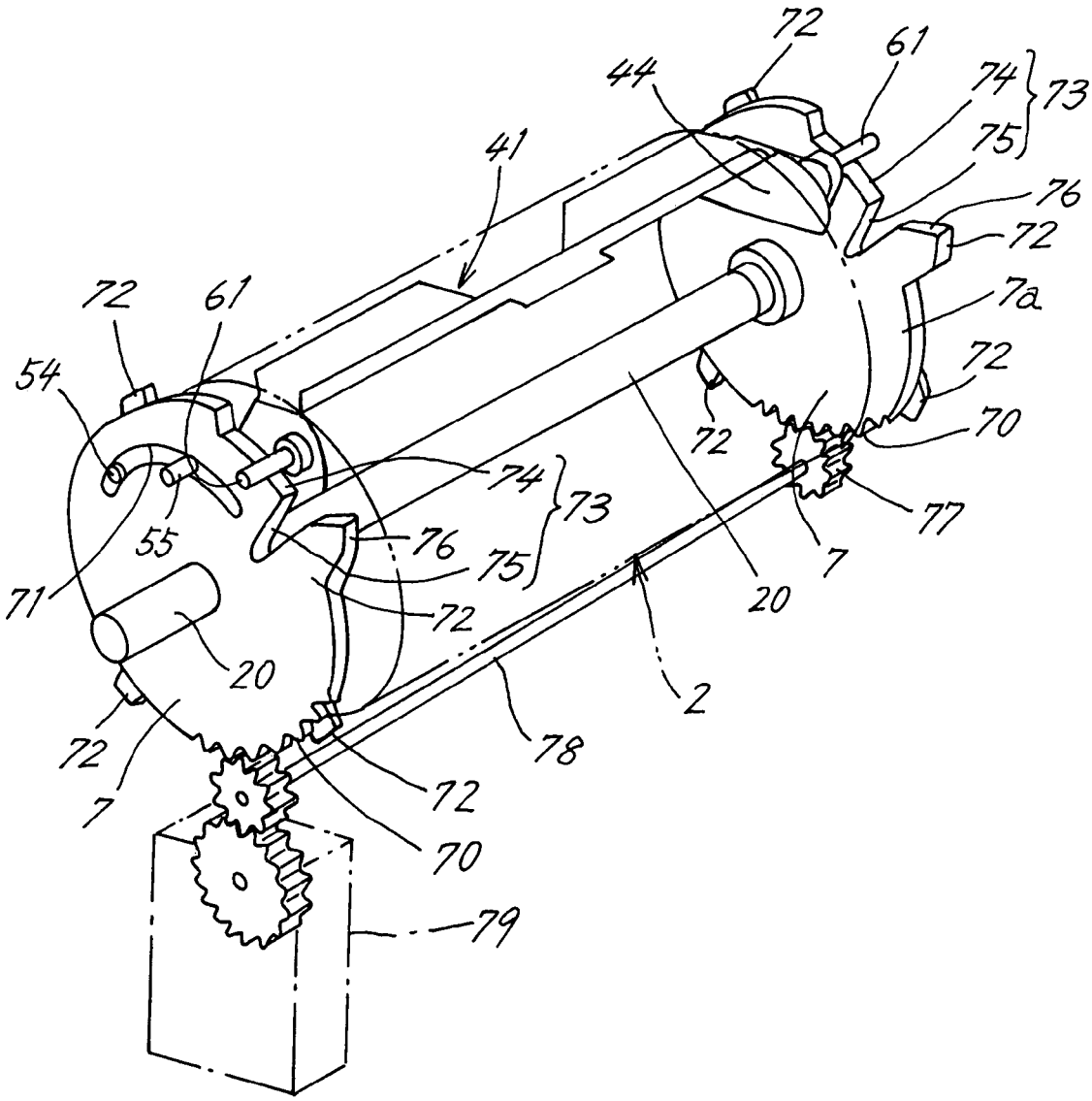
FIG. 4 is an oblique view of a platen roller to which a sheet feed guide is attached.
Figure 5:
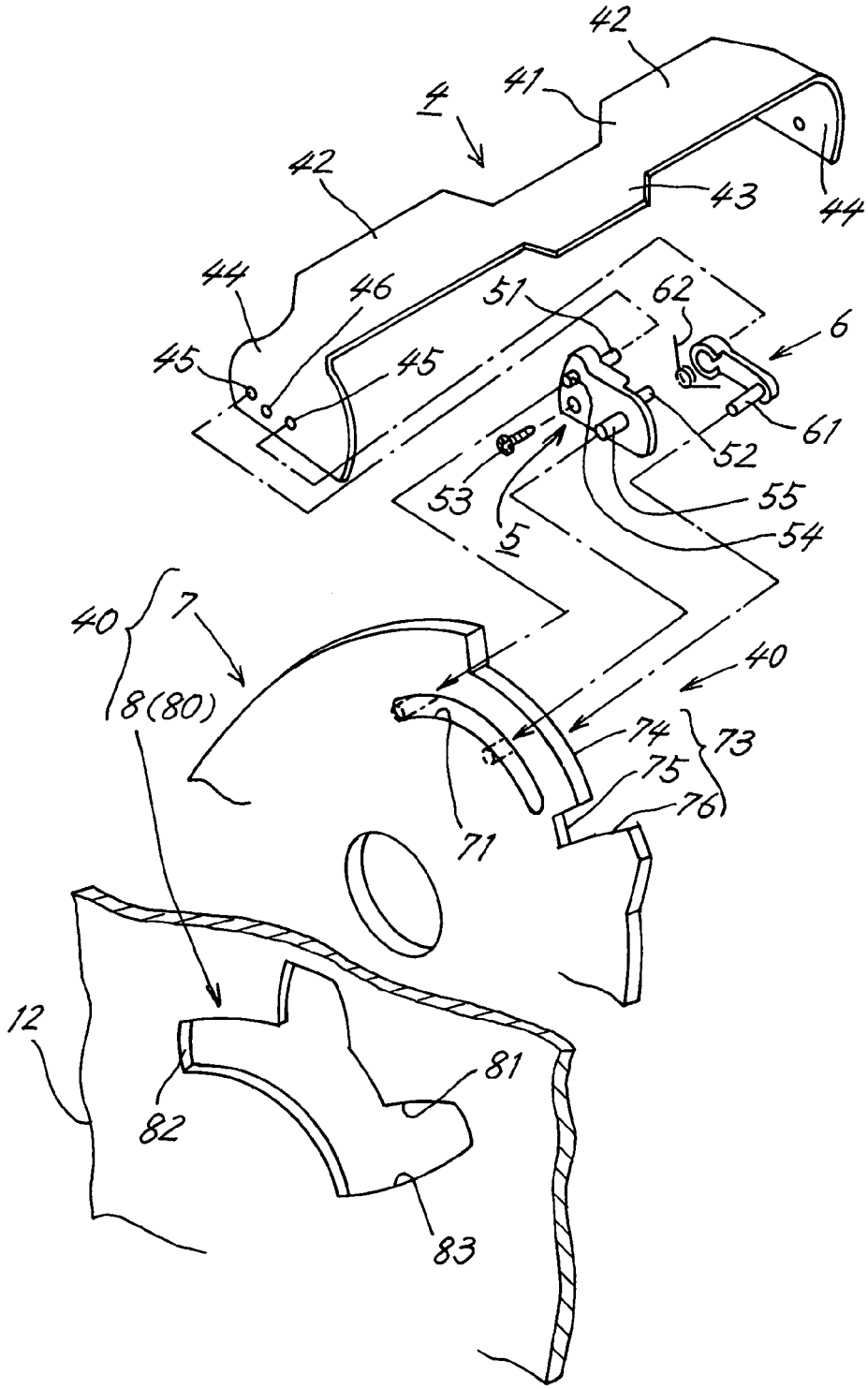
FIG. 5 is an exploded oblique view of the sheet feed guide.

FIG. 4 is an oblique view of the platen roller 2 to which the sheet feed guide 4 is attached, and FIG. 5 is an exploded oblique view of the sheet feed guide 4. The sheet feed guide 4 includes: a guide plate 41 for guiding the paper sheet S that has passed under the first winding support member 21 between the second winding support member 22 and the platen roller 2; support plates 44, 44 furnished at both ends of the guide plate 41; and a mounting member 5 and a lever 6 that are provided on each of the support plates 44. The guide plate 41 and the support plates 44, 44 are formed by bending a sheet of metal plate.

The guide plate 41 is formed slightly longer than the platen roller 2, and it has a smaller wing piece 43 facing frontward at its center, and larger wing pieces 42, 42 facing rearward on both sides of the smaller wing piece 43.

The support plates 44, 44 oppose each other, and each of the support plates 44 has two positioning holes 45, 45 and a screw hole 46.

The mounting member 5 is positioned on the outer surface of the support plate 44, and is fastened on the support plate 44 by fitting positioning rods 51 and 52 protruding from the inner side into the positioning holes 45, 45 in the support plate 44, and screwing a screw 53 into a screw hole 46.

The outer surface of the mounting member 5 is furnished with two shorter and longer guide rods 54 and 55 that slidably fit into a guide groove 71 of a later-described rotative plate 7 or 7*a*.

The base end of the lever 6 fits onto the positioning rod 52 of the mounting member 5 pivotably. A round-rod-like protuberance 61 protrudes outwardly from the free end of the lever 6 along the length of the guide plate 41 (along the length of the platen roller 2).

Referring to FIG. 5, the lever 6 is urged by a spring 62 anticlockwise (in the direction in which a cam portion 73 of the later-described rotative plate 7 or 7*a* is pressed).

Rotative Plate 7

As illustrated in FIG. 4, rotative plates 7 and 7*a* are attached onto each end of a rotation shaft 20 of the platen roller 2 freely-pivotably with respect to the shaft 20.

Gears 77, 77 mesh with gear-tooth faces 70, 70 formed on a portion of the outer periphery of both rotative plates 7 and 7*a*, and both gears 77, 77 are linked together by a shaft 78.

A rotation drive device 79 is connected to one of the gears 77. The rotation drive device 79 turns the rotative plates 7 and 7*a* in a forward or reverse direction corresponding to each of later-described respective modes of the printer apparatus in response to the signal from a control section (not shown).

An arcuate guide groove 71 into which the guide rods 54 and 55 on the sheet feed guide 4 are fitted slidably is formed in each of the rotative plates 7 and 7*a*.

With the guide groove 71 and the guide rods 54 and 55, the sheet feed guide 4 is guided so as to shift back and forth over the platen roller 2 while keeping a clearance between the guide plate 41 and the platen roller 2, through which a paper sheet passes. The center of curvature of the guide groove 71 matches the center of rotation of the rotative plates 7 and 7*a*.

A cam portion 73 that comes in contact with the protuberance 61 of the lever 6 is formed on the outer peripheral surface of each of the rotative plates 7 and 7*a*.

The cam portion 73 includes an arcuate face 74 the center of curvature of which 5 matches the guide groove 71, a pocket 75 recessed from the front end of the arcuate face 74, and a pressure cam face 76 that connects to the pocket 75 and extends radially of the rotative plates 7 and 7*a*.

The protuberance 61 of the lever 6 fits into the pocket 75 with a slight clearance. The pocket 75 is positioned slightly forward of the front end of the guide groove 71.

In addition, as shown in FIG. 4, four cam pieces 72, 72 protrude from the outer peripheral surface of each of the rotative plates 7 and 7*a*, for separating the winding support members 21, 22, 23, and 24 from the platen roller 2 against the spring (not shown).

A rotation-restricting part 8 that restricts the rearward shifting of the sheet feed guide 4 according to switching of the modes is provided on the outer side of each of the rotative plates 7 and 7*a*. The rotation-restricting part 8 employed in the present example is a punched-out hole 80 formed in each of the side plates 11 and 12 of the chassis 1.

The punch-through hole 80 includes a first contact portion 81 that prevents the rearward shift of the sheet feed guide 4 by coming into contact with the protuberance 61 during the time in which the rotative plates 7 and 7*a* rotates in the forward direction (anticlockwise) and the protuberance 61 falls into the pocket 75, a second contact portion 82 that prevents the rearward shift of the sheet feed guide 4 by coming into contact with the guide rod 55 on the sheet feed guide 4, and a guiding surface 83 that guides the protuberance 61 that has fallen into the pocket 75 in the rotative plates 7 and 7*a* in a direction in which it comes out of the pocket 75 when the rotative plates 7 and 7*a* rotates in a reverse direction.

Operation Modes of Thermal Printer

Figure 6:
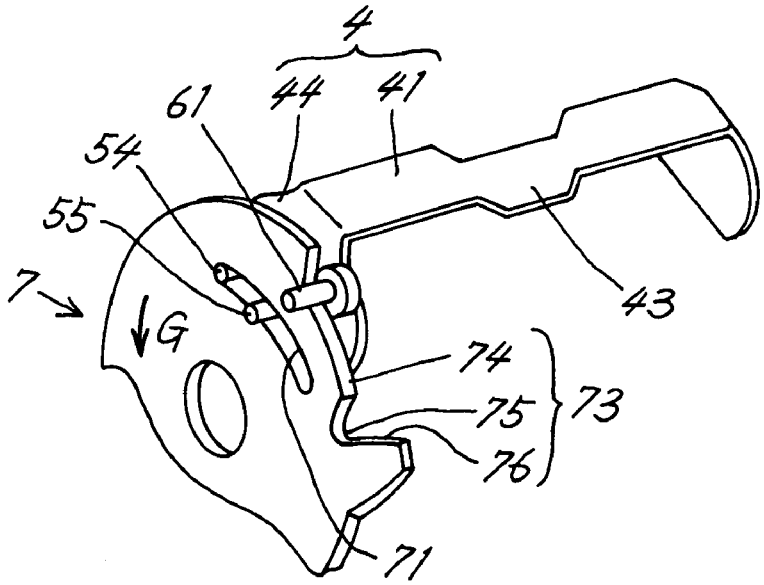
FIG. 6 is an oblique view of a rotative plate and the sheet feed guide in an initial mode.
Figure 10:
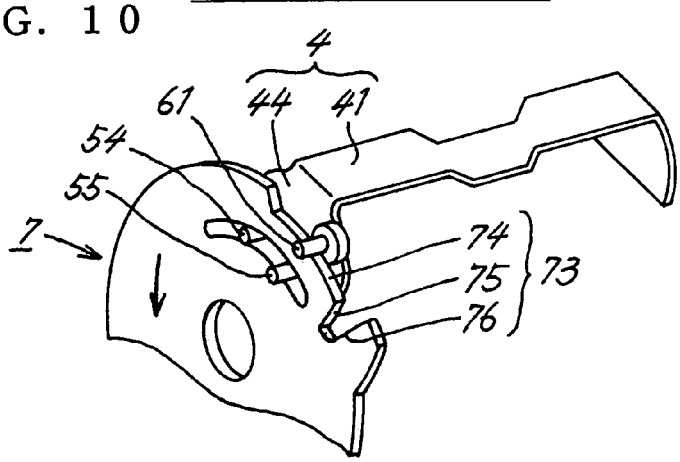
FIG. 10 is an oblique view of the rotative plate and the sheet feed guide in a sheet ejecting mode.
Figure 11:
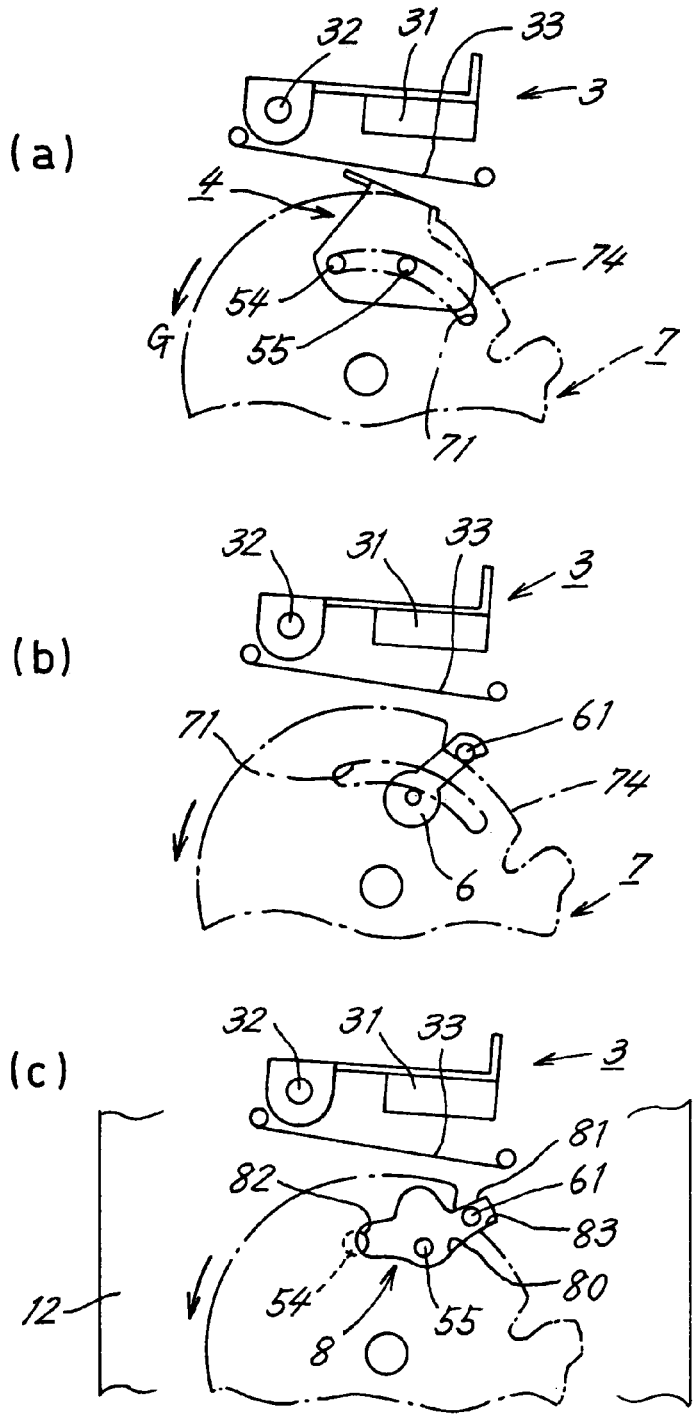
FIG. 11 is a front view of the rotative plate and the sheet feed guide in the initial mode.

The printer of the present example has five operation modes: an initial mode, a sheet feed mode, a print mode, an ink-sheet feed mode, and a sheet ejecting mode. FIGS. 6 and 11 illustrate the operation of the initial mode, FIGS. 7 and 12 the sheet feed mode, FIGS. 8 and 13 the print mode, FIGS. 9 and 14 the ink-sheet feed mode, and FIGS. 10 and 15 the sheet ejecting mode.

In each of FIGS. 11 through 15, the drawing labels (a) represents the positional relationship between the rotative plate 7 and the sheet feed guide 4, the drawing labeled (b) represents the positional relationship between the rotative plate 7 and the lever 6, and the drawing labeled (c) represents the positional relationship between the rotative plate 7 and the rotation-restricting part 8.

The initial mode is a mode in which the winding support members 21, 22, 23, and 24 are separated from the platen roller 2 and stand by for winding a paper sheet S on the platen roller 2. The printer apparatus automatically returns to the initial mode after use.

The sheet feed mode is a mode in which a paper sheet is drawn out from the sheet feed tray 17 and wound around the platen roller 2.

The print mode is a mode in which the thermal head 31 pivots toward the platen roller 2 side and presses the ink ribbon 33 against the paper sheet S to perform printing.

The ink-sheet feed mode is a mode in which, in order to finish the printing operation for one or two colors and print the next color, the ink sheet is transferred by 1 pitch, and the platen roller 2 is slightly rotated to transfer the paper sheet S on the platen roller 2 to a print initial position.

The sheet ejecting mode is a mode in which the printing operation for three colors has been finished and the paper sheet is taken out from the platen roller 2.

Figure 16:
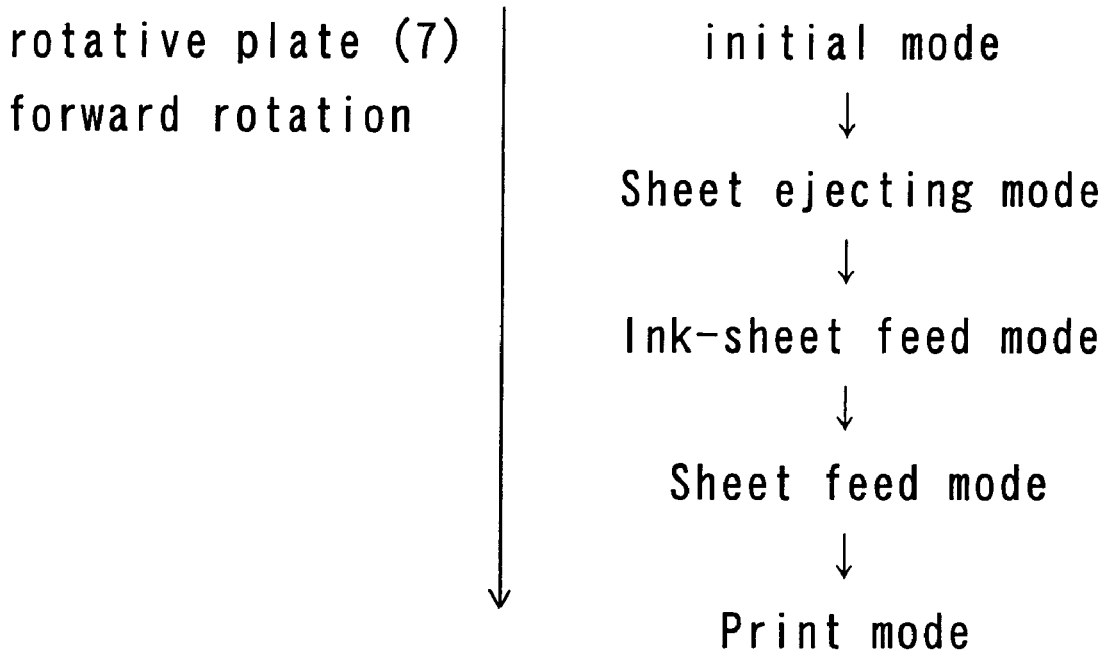
FIG. 16 illustrates the sequence of the modes that change when the rotative plate rotates in a forward direction.

The rotative plates 7 and 7*a* rotates in the forward or reverse direction according to switching of the modes. The platen roller 2 rotates only clockwise. The rotative plates 7 and 7*a* are rotated in the forward direction (anticlockwise) from the initial mode until the sheet feed mode. The sheet ejecting mode and the ink-sheet feed mode are passed during the transition, as shown in FIG. 16. When the rotative plates 7 and 7*a* further rotate in the forward direction from the sheet feed mode, the print mode is reached.

A feature of the present example is a diverting mechanism 40 that shifts the sheet feed guide 4 to prevent the interference between the thermal head 31 and the sheet feed guide 4 immediately before reaching the print mode. The diverting mechanism 40 is constituted by the rotative plate 7 and the rotation-restricting part 8.

Transition from Initial Mode to Sheet Feed Mode

In the initial mode the winding support members 21, 22, 23, and 24 are separated from the platen roller 2 by the cam pieces 72, 72.

In order to perform a printing operation, first, a paper sheet S is wound around the platen roller 2. This requires that the rotative plates 7 and 7*a* are rotated in the forward direction (anticlockwise, indicated by arrow G) from the initial mode illustrated in FIG. 6 and FIG. 11 until the sheet feed mode is reached. During the sheet ejecting mode and the ink-sheet feed mode, which are performed in the transition, the protuberance 61 of the lever 6 is pressurized against the arcuate face 74 of the cam portion 73 by a spring 62. In addition, the fore-end of the protuberance 61 is in contact with the first contact portion 81 of the rotation-restricting part 8, as illustrated in FIG. 11(*c*), thus preventing its rearward shifting.

The center of curvature of the guide groove 71 into which the guide rods 54 and 55 fit and the center of curvature of the arcuate face 74 along which the protuberance 61 slides both match the center of rotation of the rotative plates 7 and 7*a*, and the first contact portion 81 prevents the lever 6 from shifting rearward. That is, the shift of the sheet feed guide 4 in the escape direction is prevented. Therefore, the sheet feed guide 4 does not follow the rotation of the rotative plates 7 and 7*a* but stays still even when the rotative plates 7 and 7*a* rotate in the forward direction, i.e., in the direction indicated by arrow G, from the initial mode shown in FIG. 6 until the ink-sheet feed mode shown in FIG. 9, which is halfway, is reached.

Figure 7:
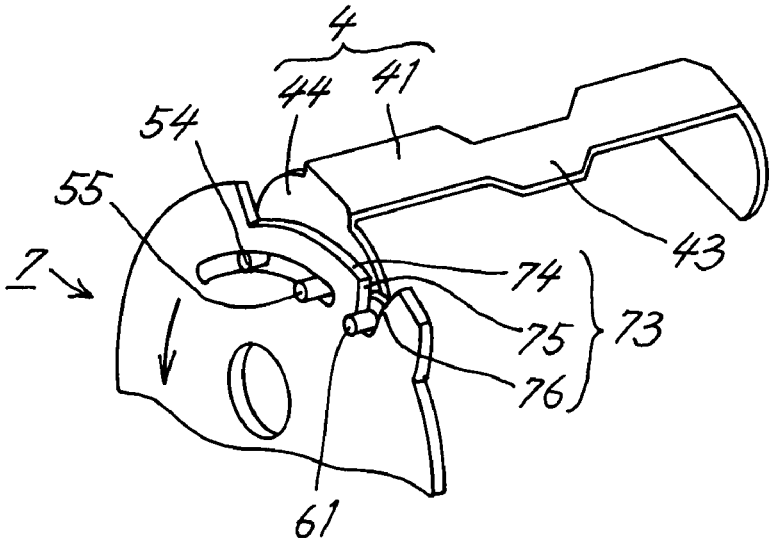
FIG. 7 is an oblique view of the rotative plate and the sheet feed guide in a sheet feed mode.
Figure 12:
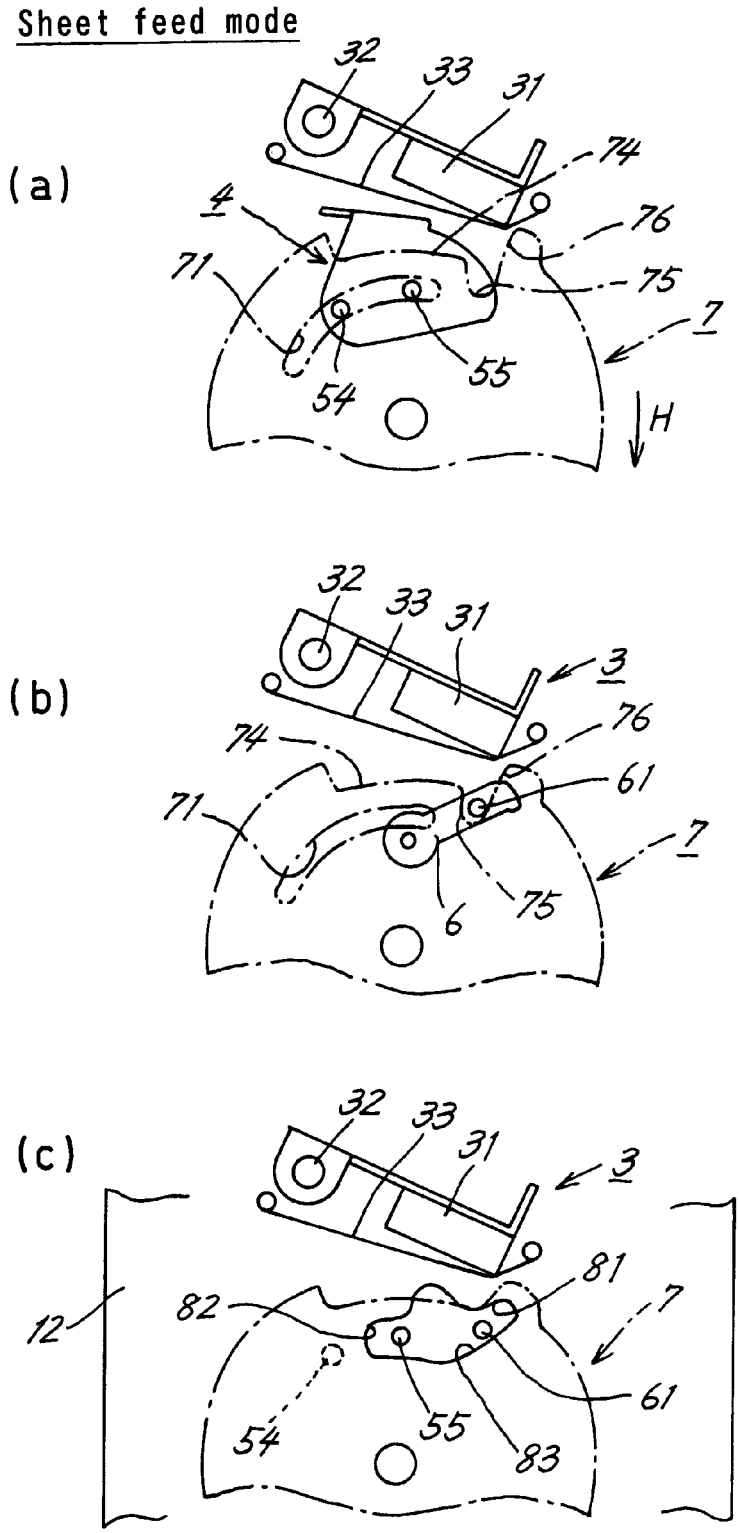
FIG. 12 is a front view of the rotative plate and the sheet feed guide in the sheet feed mode.

As illustrated in FIGS. 7 and 12, when the rotative plates 7 and 7*a* rotate in the forward direction until the sheet feed mode is reached, the protuberance 61 of the lever 6 falls into the pocket 75 of the cam portion 73, thereby making contact with the guiding surface 83 of the rotation-restricting part 8. At the same time, the protuberance 61 comes off from the first contact portion 81 of the rotation-restricting part 8, as illustrated in FIG. 12(*c*).

The protuberance 61 that has fallen into the pocket 75 also comes into contact with a pressure cam face 76 of the cam portion 73, thereby slightly shifting the sheet feed guide 4 in the escape direction (rearward).

By the time the rotative plates 7 and 7*a* reach the sheet ejecting mode, which is halfway, from the initial mode, the cam pieces 72 on the outer periphery of the rotative plates 7 and 7*a* come off from the winding support members 21, 22, 23, and 24. The winding support members 21, 22, 23, and 24 press the platen roller 2.

As previously described, a paper sheet S is drawn out from the rear end of the sheet feed tray 17 by the sheet feed roller 18, as illustrated in FIG. 2, and the platen roller 2 rotates in the sheet winding direction, which is indicated by arrow E. The paper sheet S, sliding on the winding guide surface 16*a*, is guided between the first winding support member 21 and the platen roller 2, as indicated by arrow X. Then, the paper sheet passes under the sheet feed guide 4, the second winding support member 22, the third winding support member 23, and the fourth winding support member 24, thus wrapping around the platen roller 2.

By detecting the fore-end of the paper sheet S by a sensor (not shown) provided at an appropriate position, the rotation of the platen roller 2 is stopped when the fore-end reaches a print reference position.

The thermal head 31 is lowered and drawn towards near the ink sheet 33. Still, there is a clearance between the head and the platen roller 2, and the head does not interfere with the sheet feed guide 4.

Transition from Sheet Feed Mode to Print Mode

Figure 8:
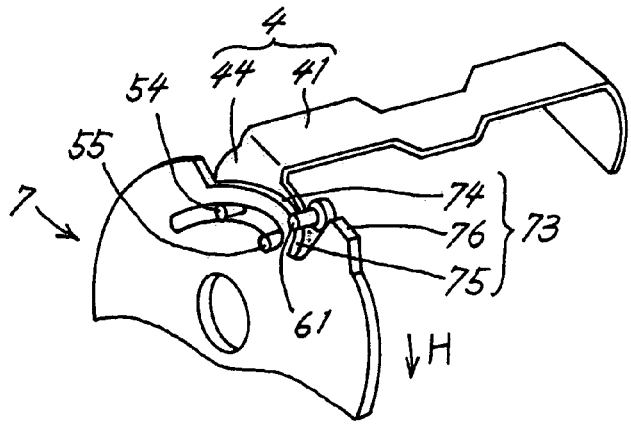
FIG. 8 is an oblique view of the rotative plate and the sheet feed guide in a print mode.
Figure 13:
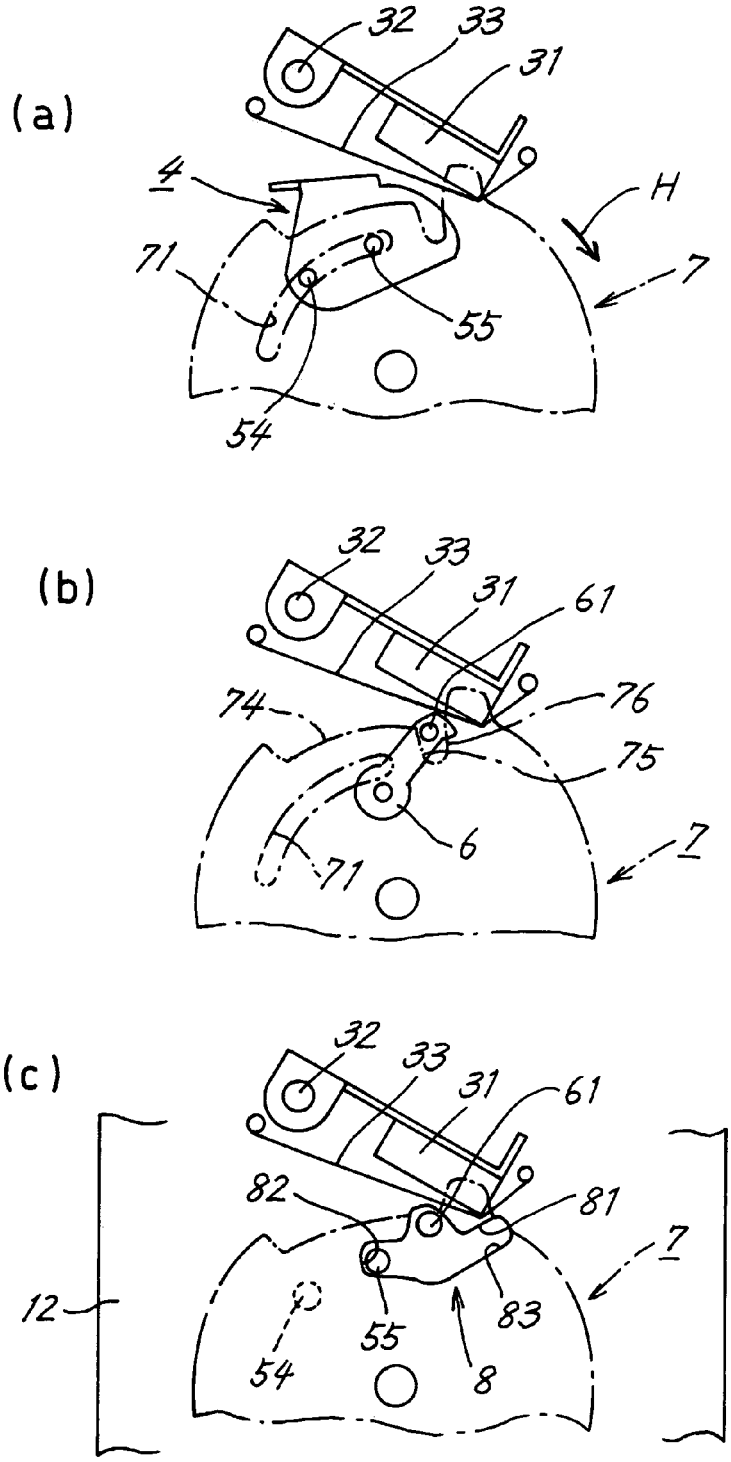
FIG. 13 is a front view of the rotative plate and the sheet feed guide in the print mode.

Upon the sensor's detection the completion of sheet feeding, the rotative plates 7 and 7*a* further rotate in the forward direction. The pressure cam face 76 of the cam portion 73 pushes the protuberance 61 on the lever 6, letting the sheet feed guide 4 escape rearward (FIGS. 8 and 13). Since the protuberance 61 has already come off from the first contact portion 81 of the rotation-restricting part 8, there is no obstacle for the sheet feed guide 4 to shift rearward.

When the guide rod 55 on the sheet feed guide 4 hits the second contact portion 82 of the rotation-restricting part 8, the rearward movement of the sheet feed guide 4 stops.

Since the sheet feed guide 4 has shifted rearward, the thermal head 31 can pivot around the support shaft 32 and descend. The thermal head 31 presses the ink sheet 33 against the paper sheet S on the platen roller 2. In this state, the platen roller 2 rotates by the length of the paper sheet, thus completing a printing operation for one color.

Transition from Print Mode to Ink-Sheet Feed Mode

Upon completing the printing operation for one color, the thermal head 31 returns to the original position, and the ink sheet 33 is wound by 1 pitch (a width for one color).

Figure 9:
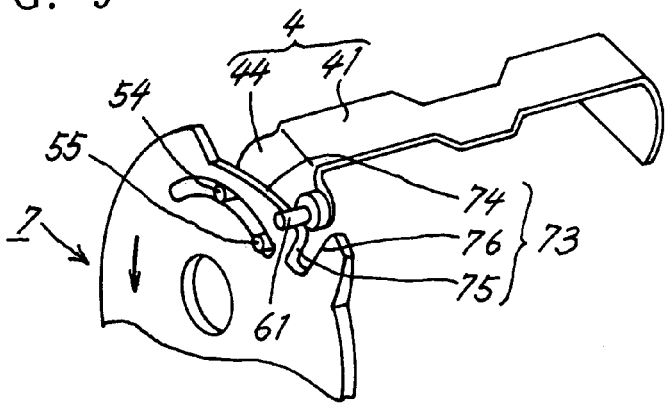
FIG. 9 is an oblique view of the rotative plate and the sheet feed guide in an ink-sheet feed mode.
Figure 14:
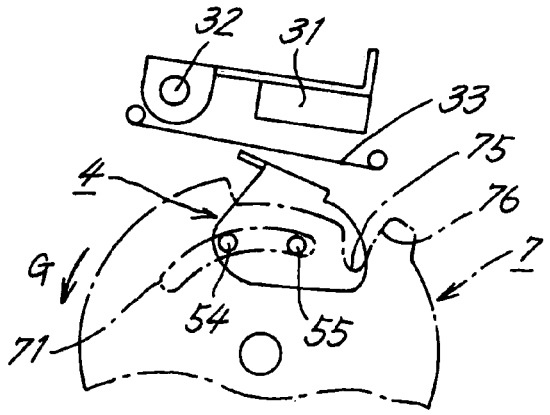
FIG. 14 is a front view of the rotative plate and the sheet feed guide in the ink-sheet feed mode.
Figure 14:
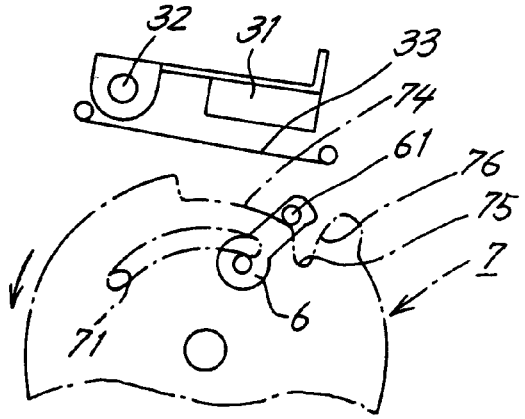
Figure 14:
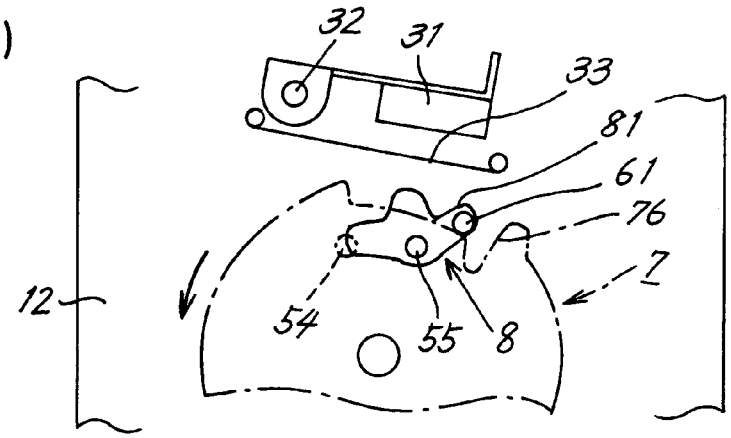
Figure 15:
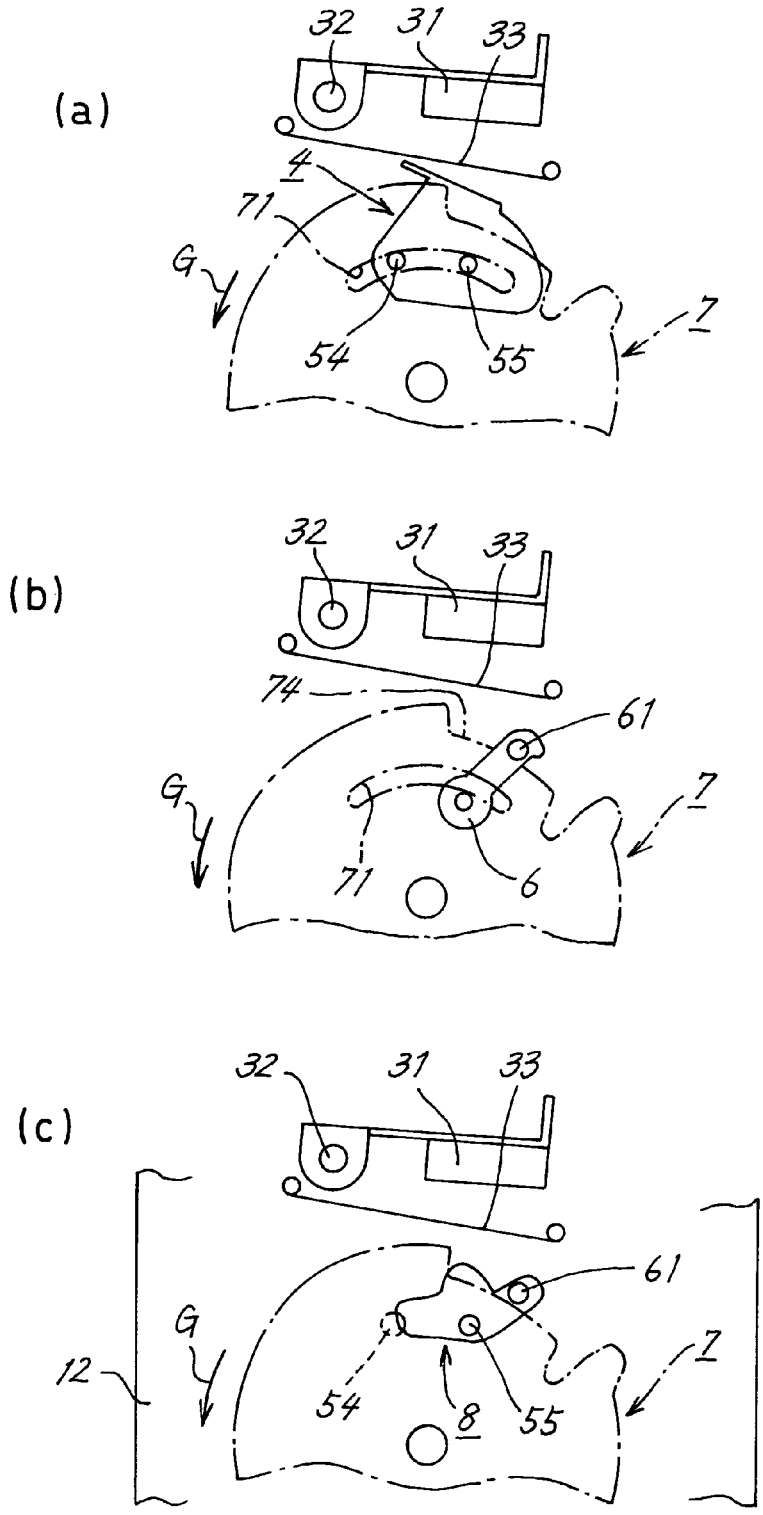
FIG. 15 is a front view of the rotative plate and the sheet feed guide in the sheet ejecting mode.

As indicated by arrow H in FIGS. 8 and 13, the rotative plates 7 and 7*a* rotate in the reverse direction, undergo the sheet feed mode shown in FIGS. 7 and 12, and move to the ink-sheet feed mode shown in FIGS. 9 and 14. By the reverse rotation of the rotative plates 7 and 7*a*, the protuberance 61 falls into the pocket 75 one time in the sheet feed mode, coming into contact with the guiding surface 83 of the rotation-restricting part 8 (FIGS. 7 and 12(*c*)). With a further reverse rotation of the rotative plates 7 and 7*a*, the wall of the pocket 75 of the cam portion 73 pushes the protuberance 61 forward. The protuberance 61 slides on the guiding surface 83 and reaches the position at which it comes in contact with the first contact portion 81 of the rotation-restricting part 8 (FIG. 14(*c*)), arriving at the ink-sheet feed mode.

The platen roller 2 rotates until the fore-end of the paper sheet S reaches the print reference position.

From the ink-sheet feed mode the rotative plates 7 and 7*a* rotates in the forward direction, returning to the print mode to perform a printing operation for the second color. The printing operation for the third color is carried out in a similar manner to the operation for the second color.

Transition from Print Mode to Sheet-Ejecting Mode

Upon completing the printing operation for the third color, the rotative plates 7 and 7*a* rotate in the reverse direction, undergo the sheet feed mode and the ink-sheet feed mode, and moves to the sheet ejecting mode. (See FIG. 16.)

Even when the rotative plates 7 and 7*a* further rotate in the reverse direction from the state of the ink-sheet feed mode, the protuberance 61 on the lever 6 still remains on the arcuate face 74 of the cam portion 73. The posture of the sheet feed guide 4 is the same as that in the ink-sheet feed mode.

As indicated by arrow Y in FIG. 2, the guiding plate 19 pivots downward to release the shifting path between the fourth winding support member 24 and the sheet-ejecting guide surface 16*b* of the guide wall 16. The platen roller 2 rotates clockwise, whereby the sheet is elevated upward along the sheet-ejecting guide surface 16*b* of the guide wall 16 and is thus ejected.

When completing the paper sheet ejection, the guiding plate 19 returns to the original position to get ready for winding of the next paper sheet S.

Advantageous Effects of the Present Example

A plurality of winding support members 21, 22, 23, and 24 for guiding the paper sheet S to wrap around the roller 2 are provided circumferentially around the platen roller 2, and the approach/retreat operation thereof with the platen roller 2 is controlled by the cam pieces 72 of the rotative plates 7 disposed opposing both ends of the platen roller 2. This makes the size of the printer apparatus smaller than conventional printer apparatus.

Moreover, even if the sheet feed guide 4 and the printing means 3 are arranged close to each other, the diverting mechanism 40 lets the sheet feed guide 4 escape to a position at which it does not interfere printing operations in the print mode. This also serves to reduce the size of the printer apparatus.

Since the operation of the sheet feed guide 4 is controlled by the rotative plate 7 and the rotation-restricting part 8, which constitute the diverting mechanism 40, the operation of the sheet feed guide 4 becomes stable, thereby improving reliability.

It should be noted that it is not absolutely necessary to match the pivotal axis of the sheet feed guide 4 with the center of rotation of the rotative plates 7 and 7*a*. It is sufficient that a paper sheet can be guided between the second winding support member 22 and the platen roller 2 when the sheet feed guide 4 pivots frontward, and that the sheet feed guide 4 does not interfere with the thermal head 31 when it pivots rearward.

The present invention is not limited to thermal printers. The invention may be applied to, for example, printers that are capable of printing images, which include printing of characters, and to photocopiers. Further, the printing means may be of an ink-jet type.

Adjusting Mechanism 9

Figure 17:
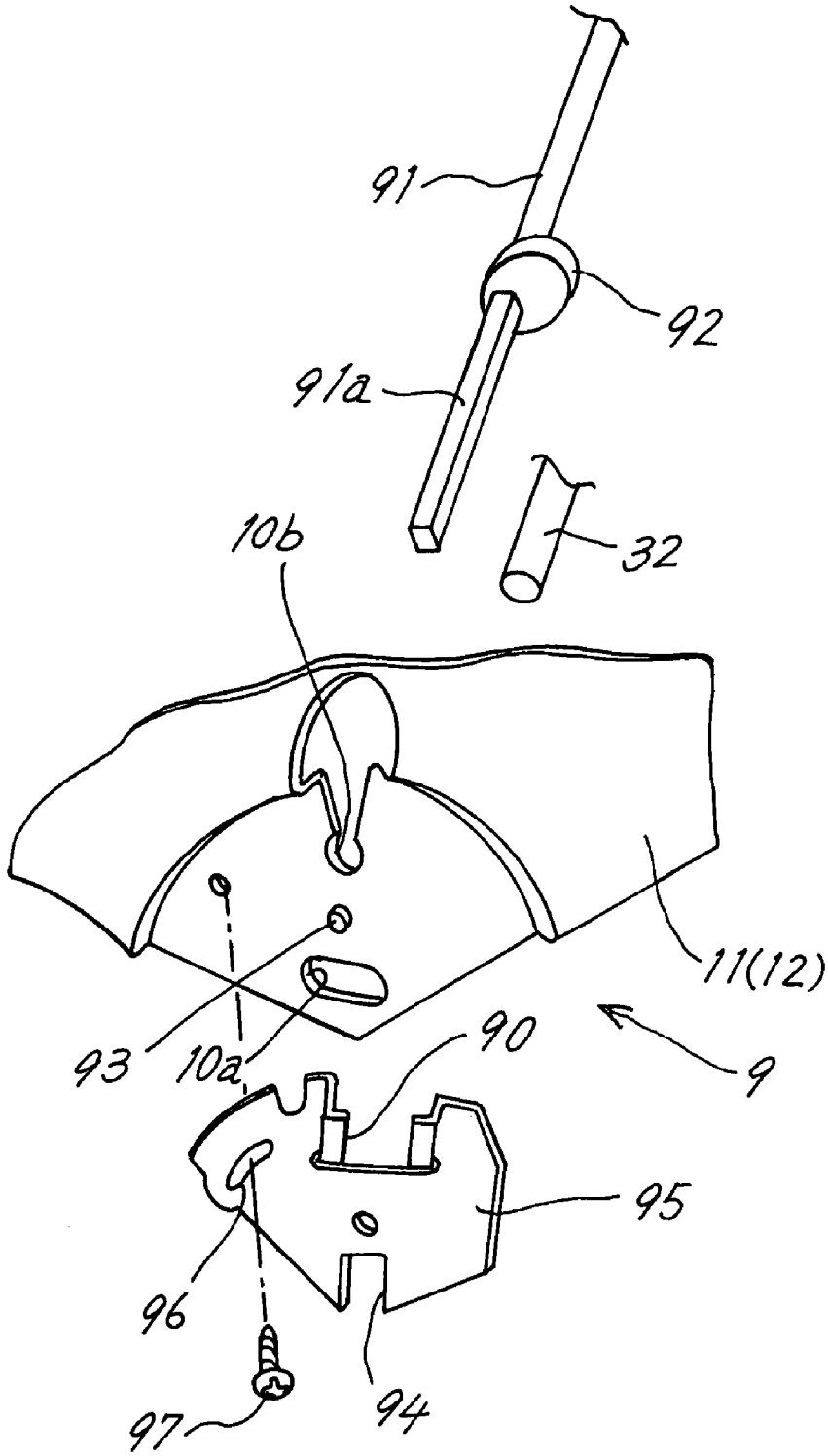
FIG. 17 is an exploded oblique view of an adjusting mechanism.
Figure 18:
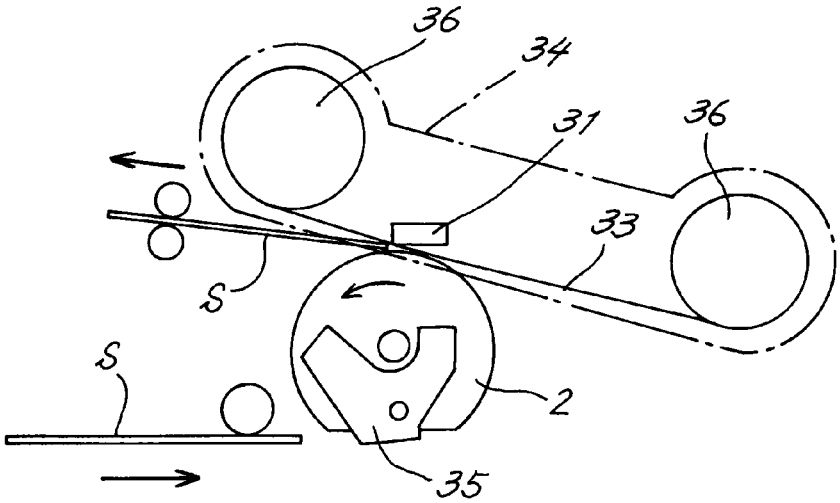
FIG. 18 PRIOR ART
FIG. 18 is a schematic side view illustrating a portion of a conventional printer apparatus.
Figure 19:
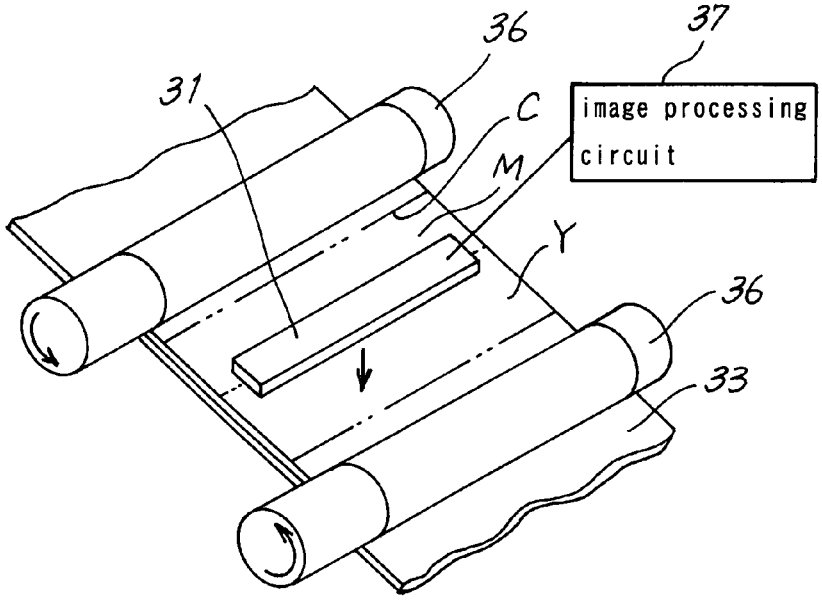
FIG. 19 PRIOR ART
FIG. 19 is an oblique view illustrating winding shafts of the cartridge.

It should be noted that, as seen from FIGS. 1, 2, and 17, the thermal head 31 is linked to an adjusting mechanism 9, and its pressurizing position on the platen roller 2 is adjusted to-and-fro.

Both ends of the support shaft 32 of the thermal head 31 pass through arcuate long holes 10*a* formed in the side plates 11 and 12 of the chassis 1. The adjusting mechanism 9 shifts the support shaft 32 to-and-fro by pivoting the pivot plates 95 disposed on the side plates 11 and 12.

An adjustment shaft 91 arranged parallel to the support shaft 32 is fitted freely-pivotably into holes 10*b* formed in the side plates 11 and 12. The pivot plate 95 is supported rotatably on each of the side plates 11 and 12 by the protruding rod 93 provided between the long hole 10*a* and the hole 10*b*.

The pivot plate 95 has two larger and smaller notches 90 and 94, with the center of rotation interposed therebetween, and one end of the support shaft 32 of the thermal head 31 fits into the smaller notch 94, which is at the lower portion, whereas an eccentric circular portion 92 formed on the adjustment shaft 91 fits into the larger notch 90, which is at the upper portion.

An arcuate hole 96, the center of curvature of which matches the protruding rod 93, is formed in the pivot plate 95. When an angular shaft portion 91*a* on one end of the adjustment shaft 91 is turned with a rotating tool (such as, a spanner), the eccentric circular portion 92 rotates, thus pivoting the pivot plate 95. As a result, the support shaft 32 can be shifted back and forth along the long hole 10*a* so that the position of the thermal head 31 can be optimally adjusted.

After adjusting the position of the thermal head 31, a screw 97 fitted into the arcuate hole 96 of the pivot plate 95 is screwed to each of the side plates 11 and 12 to secure the pivot plate 95 on each of the side plates 11 and 12.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. A printer apparatus comprising:

a platen roller around which paper sheets wind;

a printing means arranged for being drawn near to and away from the platen roller;

a plurality of winding support members circumferentially disposed around the platen roller, for guiding a paper sheet to wrap around the roller;

a sheet feed guide disposed in proximity to the printing means and being pivotable substantially along the circumference of the roller; and a diverting mechanism for letting the sheet feed guide escape to a position such that it does not interfere with the printing means in a print mode; wherein the sheet feed guide is linked with a lever that pivots in a plane substantially perpendicular to the rotation axis of the platen roller, the lever having a fore-end protuberance, the diverting mechanism comprises rotative plates disposed opposing each end of the platen roller and each having a cam portion for guiding the protuberance on the lever, and a rotation-restricting part for controlling movement of the lever in cooperation with the cam portion to let the sheet feed guide escape during the print mode, and cam pieces provided on the rotative plates control an approach/retreat operation of the winding support members with the respect to the platen roller.

2. The printer apparatus according to claim 1, wherein:

the cam portion on each rotative plate has an arcuate face, a pocket recessed into the arcuate face, and a pressure cam face for pushing the protuberance to let the sheet feed guide escape when the rotative plate rotates in a forward direction to shift in the print mode; and the rotation-restricting part comprises a first contact portion for coming into contact with the protuberance when the rotative plates rotate in a forward direction from an initial mode to a sheet feed mode, a second contact portion for preventing the sheet feed guide from escaping when the rotative plates rotate in a forward direction and switch from the sheet feed mode to a print mode, and a guiding surface for cooperating with a wall of the pocket to cause the protuberance having fallen into the pocket of the rotative plate to come out when the rotative plates rotate in a reverse direction in order to switch from the print mode to another mode.

3. The printer apparatus according to claim 2, further comprising: a guide rod formed on the sheet feed guide, for preventing the sheet feed guide from moving in the escape direction by contacting the second contact portion of the rotation-restricting part, and a guide groove formed on the rotative plate, into which the guide rod is fitted slidably, for guiding the pivoting of the sheet feed guide.

4. The printer apparatus according to claim 1, wherein the rotation-restricting part is a punched-out hole formed in a side plate of a chassis.

* * * * *